US006938663B2

(12) United States Patent
Hsu

(10) Patent No.: US 6,938,663 B2
(45) Date of Patent: Sep. 6, 2005

(54) NON-PULL CORD BLIND STRUCTURE

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/721,292

(22) Filed: Nov. 26, 2003

(65) Prior Publication Data

US 2005/0109469 A1 May 26, 2005

(51) Int. Cl.[7] ..... A47H 5/00
(52) U.S. Cl. ..... 160/84.01
(58) Field of Search ..... 160/84.01, 84.04, 160/84.05, 264, 368.1, 348

(56) References Cited

U.S. PATENT DOCUMENTS 4,986,329 A * 1/1991 Kupchunos ..... 160/84.01
5,010,944 A * 4/1991 Bussert ..... 160/354
5,025,848 A * 6/1991 Prochaska ..... 160/368.1

* cited by examiner

*Primary Examiner*—David Purol
(74) *Attorney, Agent, or Firm*—Troxell Law Office, PLLC

(57) ABSTRACT

A non-pull cord blind structure includes a blind body attached to the underside of an upper beam wherein a plurality of elongated passages are equidistantly seamed from bottom to top of the blind body thereof for a support stick to be led and adapted therein respectively. A buckling piece of a fastening belt or a hook is properly attached to the bottommost elongated passage, correspondingly matched to a plurality of buckling rings equidistantly fixed to the other elongated passages thereof respectively. Thus, via the buckling piece registered with the buckling rings thereof, the blind body is levelly raised upwards and located at a desired position thereby without any pull cords applied thereto so as to ensure the safety of children in the household. Besides, the support sticks can also be withdrawn from the elongated passages of the collected blind body before the blind body is securely located by the buckling piece thereof so as to figure out various patterns at the collected slats of the blind body in display.

5 Claims, 6 Drawing Sheets

NON-PULL CORD BLIND STRUCTURE

BACKGROUND OF THE INVENTION

The present invention is related to a non-pull cord blind structure, comprising a blind body attached to the underside of an upper beam wherein a plurality of elongated passages are equidistantly seamed from bottom to top of the blind body for a support stick to be led and adapted therein respectively. A buckling piece of a fastening belt or a hook is properly attached to the bottommost elongated passage, correspondingly matched to a plurality of buckling rings equidistantly fixed to the other elongated passages thereof respectively. Via the buckling piece registered with the buckling rings thereof, the blind body is levelly raised upwards and located at a desired position thereby without any other pull cords applied thereto so as to ensure the safety of children in the household. Otherwise, the support sticks are withdrawn from the elongated passages of the collected blind body before the blind body is fixed by the buckling piece so as to figure out various patterns at the collected slats of the blind body in display.

A conventional blind structure is usually made up of a blind body 10 attached to the underside of an upper beam 11 wherein a volute wheel unit 12 is disposed at one side of the upper beam 11 thereof in cooperation with pull cords 13 and T-shaped cords (without shown in the diagram) to fold up or unfold the blind body 10 thereby.

There are some drawbacks to such conventional blind structure. First, the volute wheel unit 12 disposed at one side of the upper beam 11 thereof must work with the pull cords 13 and T-shaped cords in operation, which is quite complex in assembly. Second, when the blind body 10 is gathered up, pull cords 13 are suspended downwards for a certain length outside the blind thereof. Children playing around the blind may easily get caught by the suspending pull cords 13. In case the blind is careless unfolded, the withdrawing pull cords 13 might hurt or even strangle the children got caught in them. Thus, the conventional blind structure poses a potential danger to children in the household.

SUMMARY OF THE PRESENT INVENTION

It is, therefore, the primary purpose of the present invention to provide a non-pull cord blind structure wherein, comprising a blind body attached to the underside of an upper beam, and a plurality of elongated passages equidistantly seamed from bottom to top of the blind body thereof for a support stick to be adapted therein respectively wherein a buckling piece is attached to the bottommost elongated passage, correspondingly matched to a plurality of buckling rings equidistantly attached to the other elongated passages thereof; whereby, via the buckling piece registered with the buckling rings thereof to locate the blind body at a desired position thereby, the blind body thereof is precisely collected or unfolded in an easy and fast manner without other volute wheel unit, pull cords, or T-shaped cords applied thereto, economically saving the cost of materials as well as the time of assembly.

It is, therefore, the second purpose of the present invention to provide a non-pull cord blind structure wherein, via the buckling piece registered with the buckling rings thereof, the blind body is easily and quickly folded up or unfolded without any other pull cords applied thereto, preventing children from getting caught therein to protect the safety of the household.

It is, therefore, the third purpose of the present invention to provide a non-pull cord blind structure wherein the blind body is levelly raised upwards and located at a desired position via the buckling piece registered with the collected buckling rings thereof. Otherwise, the support sticks are withdrawn from the elongated passages of the collected blind body before the blind body is located by the buckling piece thereof so as to figure out various patterns at the collected slats of the blind body in display, facilitating a precise operation of the present invention in an easy and fast manner.

DETAILED DESCRIPTION OF THE PREFERRED EMBODIMENTS

Figure 1:
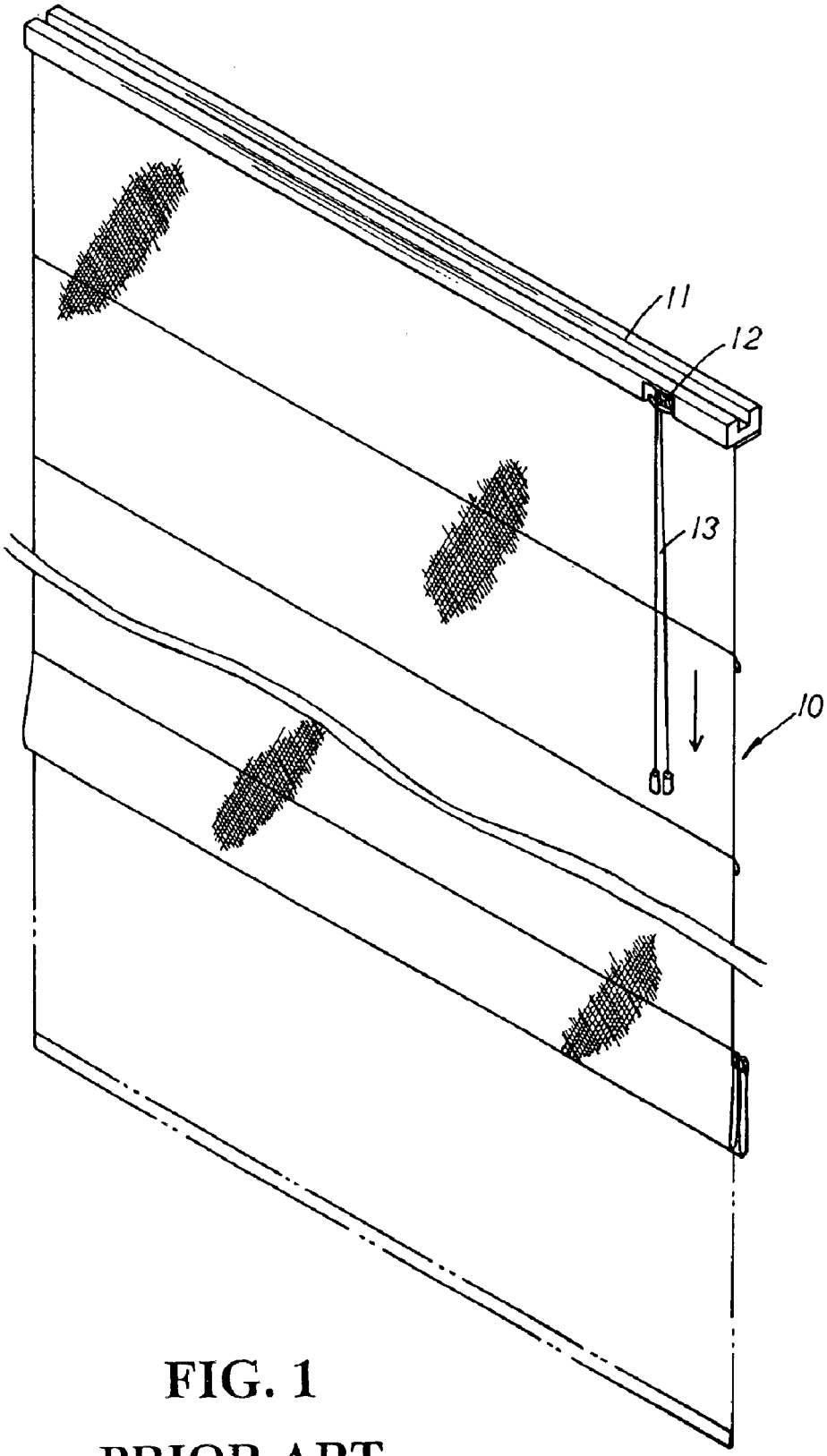
FIG. 1 PRIOR ART
FIG. 1 is a diagram showing a conventional blind structure in operation.
Figure 2:
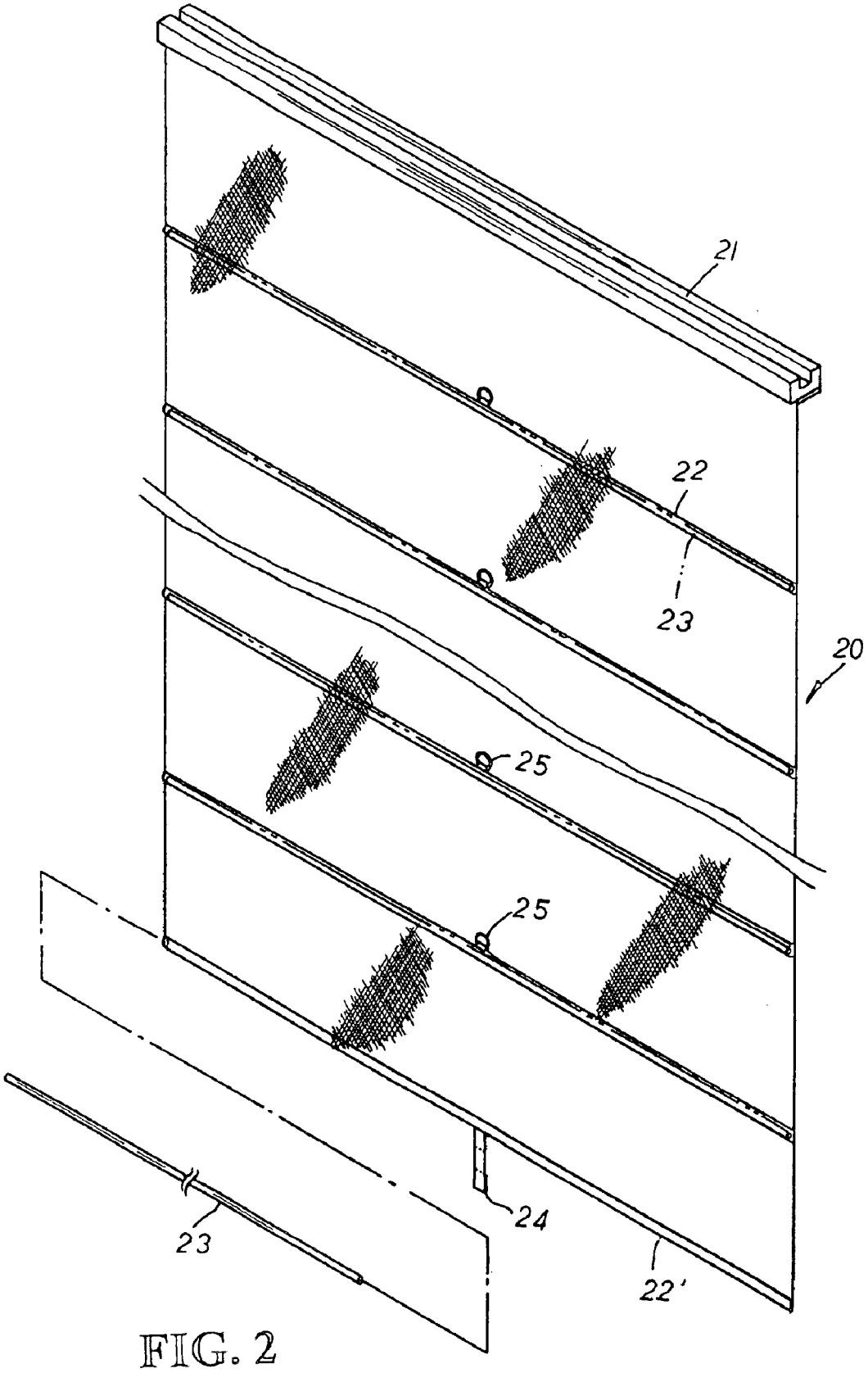
FIG. 2 is a perspective exploded view of the present invention.

Please refer to FIG. 1. The present invention is related to a non-pull cord blind structure, comprising a blind body 20 attached to the underside of an upper beam 21. A plurality of elongated passages 22 are equidistantly seamed from bottom to top of the blind body 20 with a bottommost elongated passage 22' disposed at the bottom thereof for a support stick 23 to be led and adapted therein respectively. A buckling piece 24, a fastening belt with a male and female fastening sections disposed thereon, is properly attached to the bottommost elongated passage 22', correspondingly matched to a plurality of buckling rings 25 equidistantly fixed to the elongated passages 22 thereof respectively.

Figure 3:
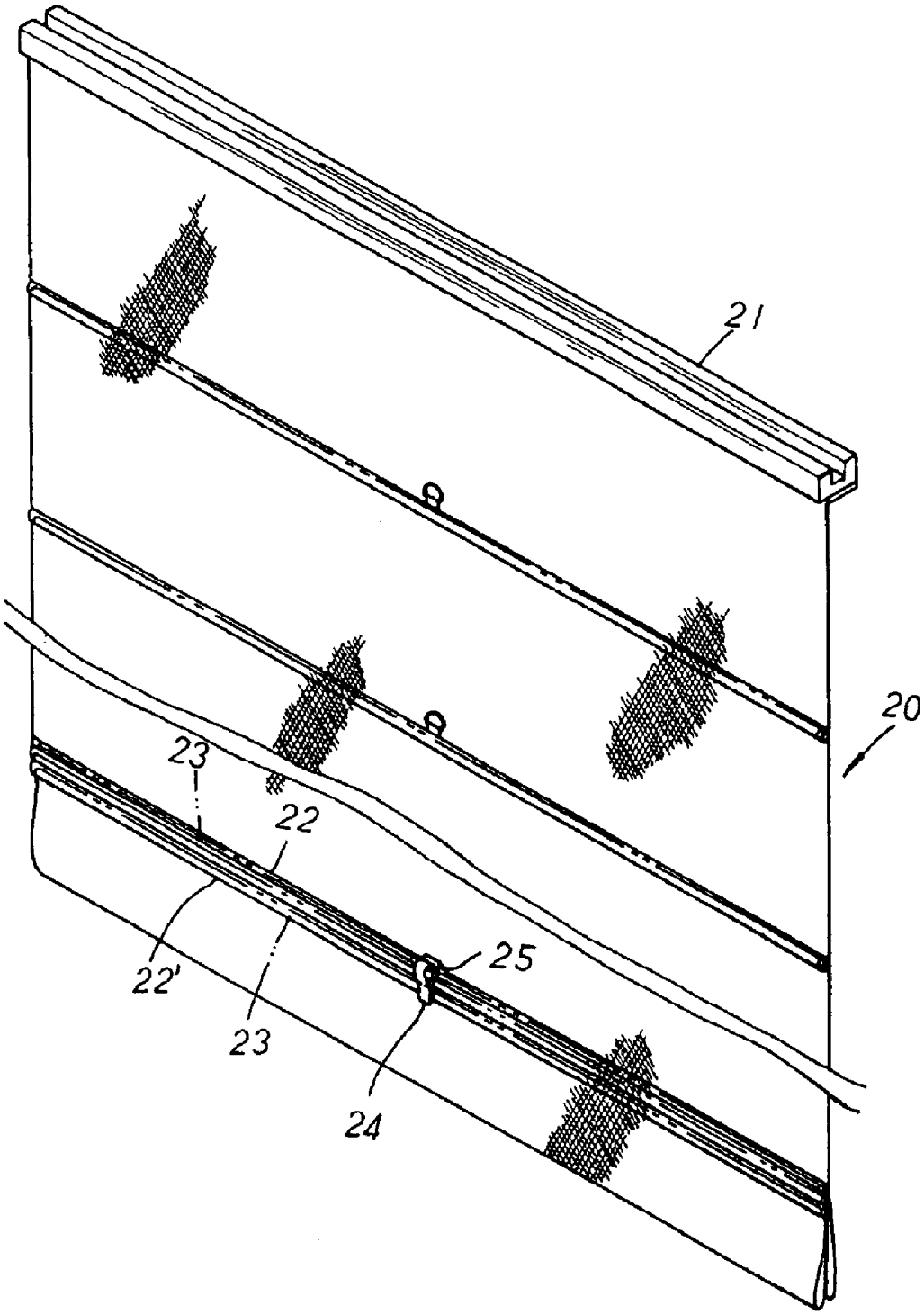
FIG. 3 is a diagram showing a blind body of the present invention in the folded-up status.
Figure 4:
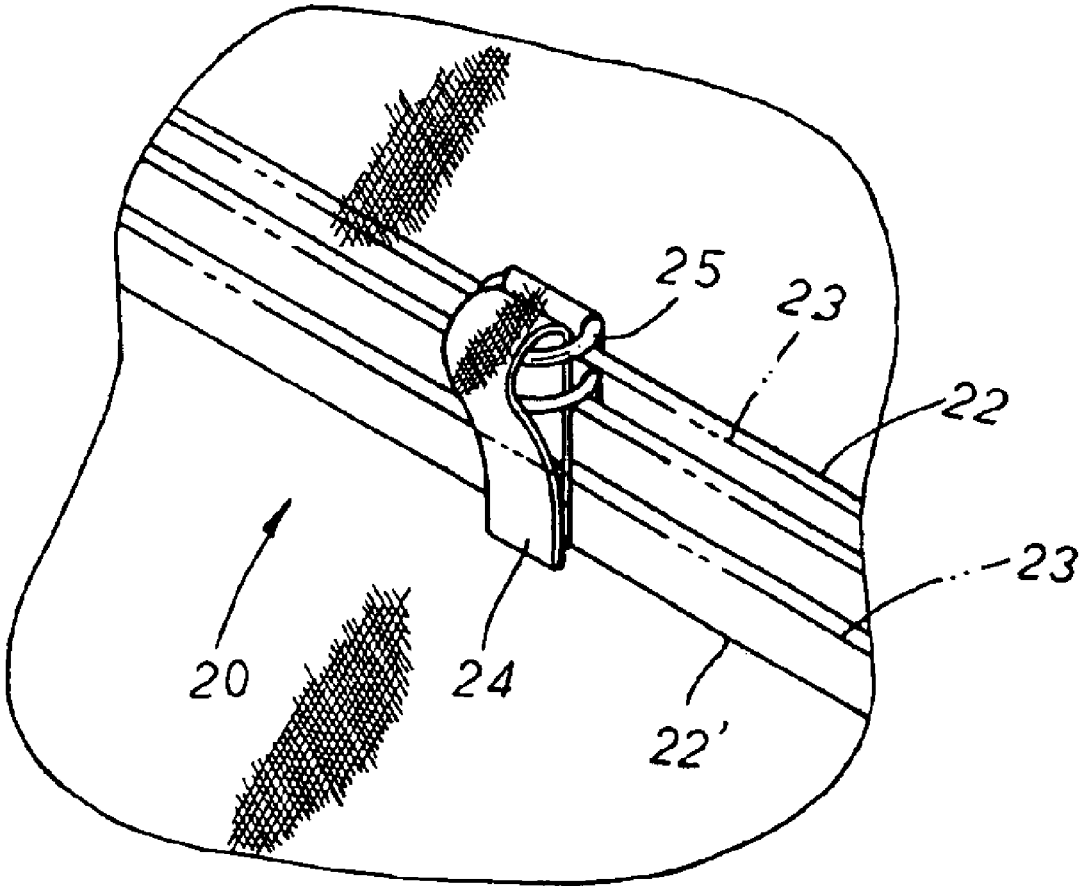
FIG. 4 is a partially enlarged view of a buckling piece registered with buckling rings of the present invention.
Figure 5:
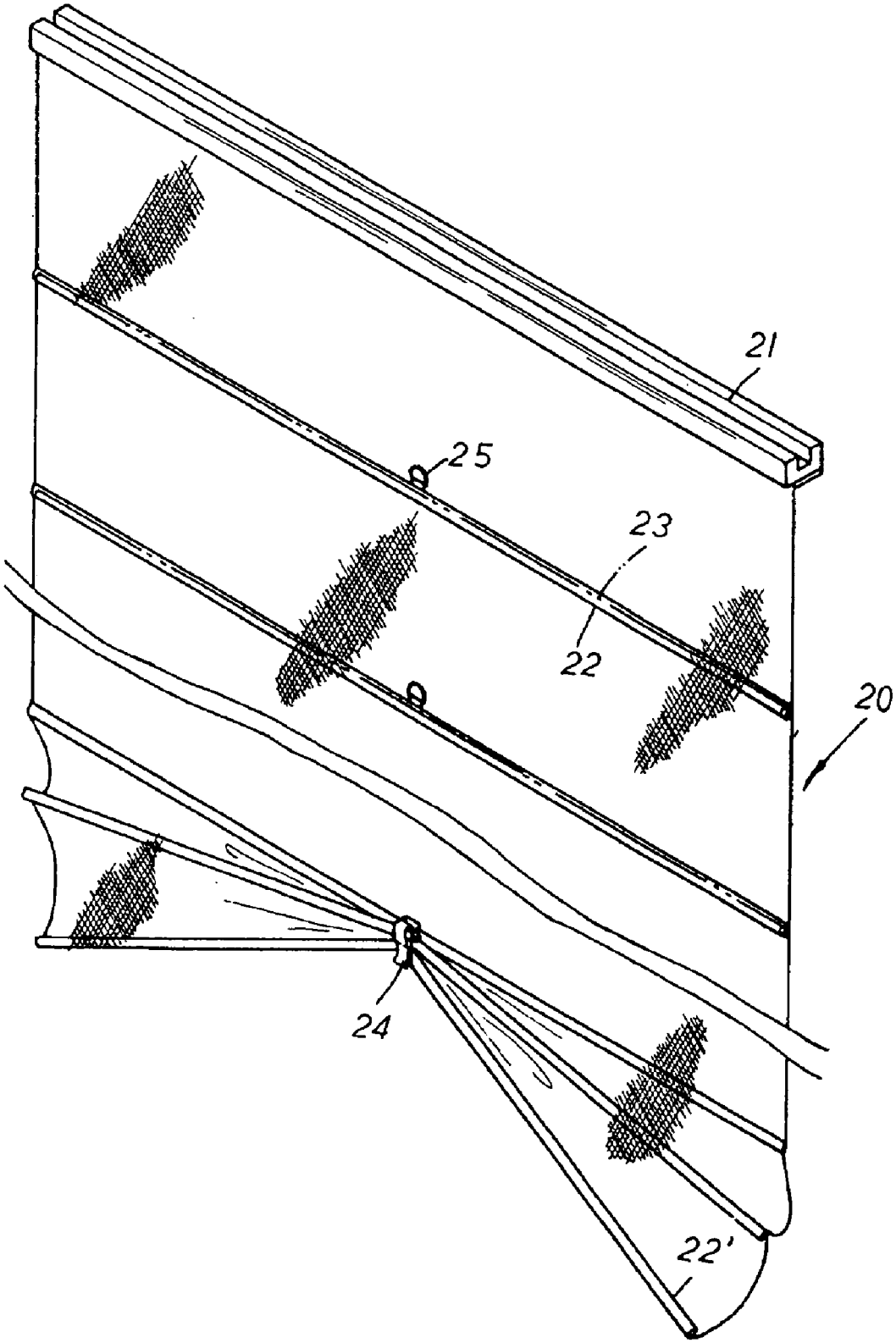
FIG. 5 is another diagram showing the blind body of the present invention in the folded-up status.

Please refer to FIG. 3. To gather the blind body 20 upwards, the buckling piece 24 is raised upwards to be led through the buckling rings 25 consecutively from bottom to top with the collected slats of the blind body 20 folded up in half piece by piece till a desired position is reached. The buckling piece 24 led and winded through the collected buckling rings 25 thereof in a row is bent downwards to be securely fixed at the bottom via the male and female fastening sections thereof as shown in FIG. 4. Thus, the blind body 20 is levelly collected upwards and located at a desired position with the buckling rings 25 securely retained and fixed by the buckling piece 24 thereof. Otherwise, the support sticks 23 adapted at the elongated passages 22, 22' of the collected blind body 20 therein can also be withdrawn respectively before the blind body 20 is located by the buckling piece 24 registered with the collected buckling rings 25 at a desired position. The collected slats of the blind body 20 can then figure out various patterns in display as shown in FIG. 5. To unfold the blind body 20, the buckling piece 24 is detached from the registered buckling rings 25, releasing the collected blind body 20 to suspend naturally downwards in display. Thus, without any other pull cords or T-shaped cords applied thereto, the blind body 20 is precisely gathered up or unfolded downwards in an easy and fast manner.

Figure 6:
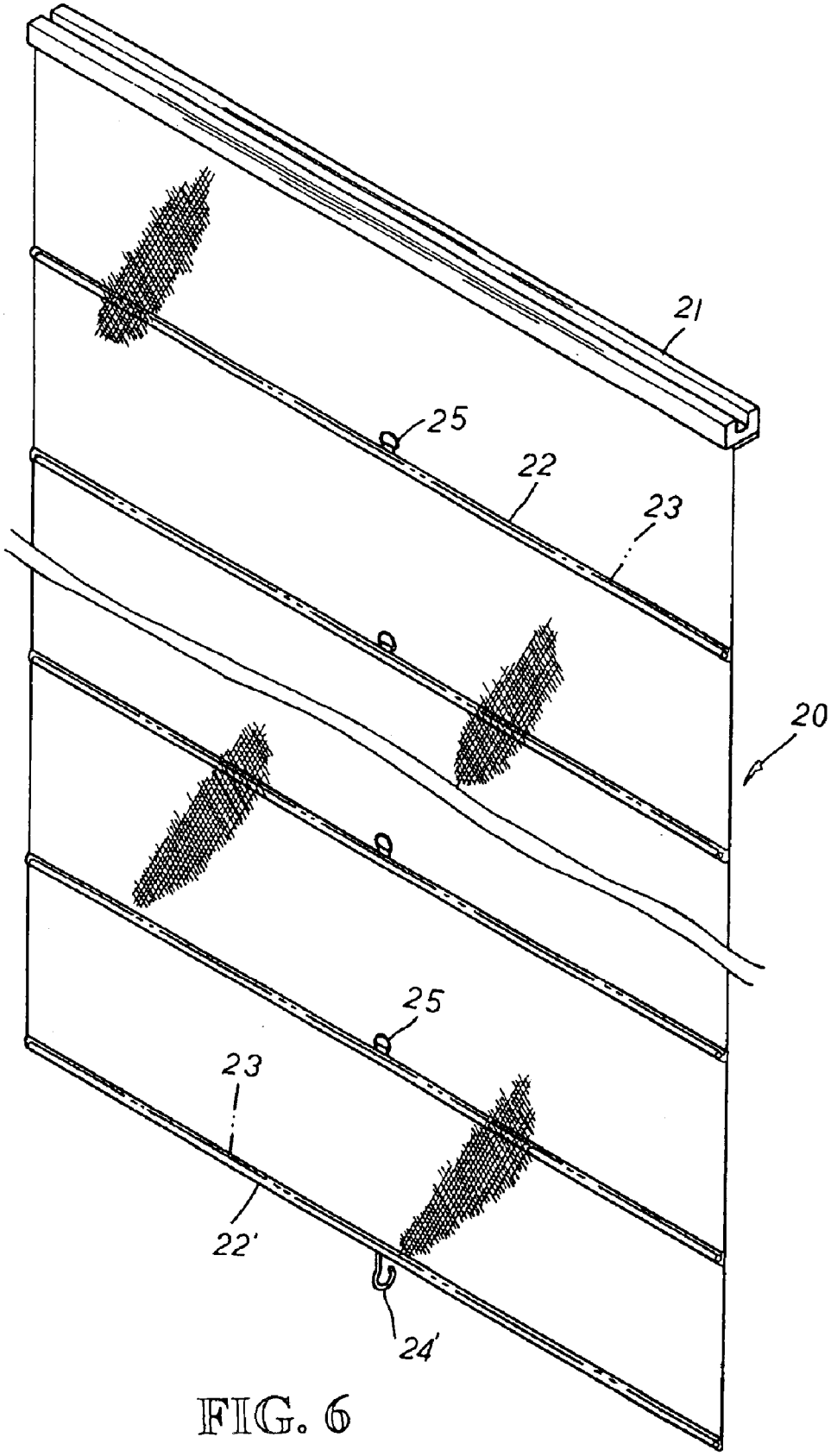
FIG. 6 is a perspective view of another embodiment of the present invention in assembly.

Please refer to FIG. 6. The blind body 20 can also have a buckling piece 24' made up of a hook disposed at the bottom thereof wherein the buckling piece 24' is directly hooked onto the collected buckling rings 25 to locate the gathered blind body 20 at a desired position.

What is claimed is:

1. A blind structure comprising:

a) an upper beam; and b) a blind body connected at an upper edge thereof to the upper beam and having:

i) a plurality of elongated passages spaced apart on the blind and extending across a width of the blind body, the plurality of elongated passages including a bottom most passage located nearest a bottom edge of the blind and a plurality of upper elongated passages located between the upper beam and the bottom most passage;

ii) a buckling piece connected to a center of the bottom most passage; and iii) a plurality of buckling rings, one buckling ring of the plurality of buckling rings being connected to a center of each of the plurality of upper elongated passages and aligning with the buckling piece, wherein the blind body is movable between extended and retracted positions, in the retracted position the buckling piece is connected to a predetermined number of the plurality of buckling rings, and in the extended position the buckling piece is disconnected from the plurality of buckling rings.

2. The blind structure according to claim 1, further comprising a support stick inserted into the bottom most passage.

3. The blind structure according to claim 1, further comprising a plurality of support sticks, one of the plurality of support sticks is inserted into each of the plurality of elongated passages.

4. The blind structure according to claim 1, wherein the bucking piece is fastening belt having male and female fastening sections.

5. The blind structure according to claim 1, wherein the bucking piece is a hook.

* * * * *